United States Patent [19]

Wallace et al.

[11] Patent Number: 4,944,843

[45] Date of Patent: Jul. 31, 1990

[54] PROCESS AND APPARATUS FOR FORMING PARTICULATE LAYERS

[75] Inventors: Peter L. Wallace, High Wycombe; Anthony J. Willis, Marlow, both of England

[73] Assignee: The Wiggins Teape Group Limited, Basingstoke, United Kingdom

[21] Appl. No.: 198,217

[22] Filed: May 25, 1988

[30] Foreign Application Priority Data

May 28, 1987 [GB] United Kingdom ..... 8712522

[51] Int. Cl.[5] ..... D21F 1/00; D21F 1/48; D21F 1/66

[52] U.S. Cl. ..... 162/101; 162/190; 162/210; 162/264; 162/336; 162/339; 162/363; 162/364

[58] Field of Search ..... 162/101, 190, 210, 264, 162/291, 336, 339, 363, 364, 348, 308, 312, 315, 317

[56] References Cited

U.S. PATENT DOCUMENTS

| | | | |
|---|---|---|---|
| 2,893,486 | 7/1959 | Marti | 162/364 X |
| 3,631,982 | 1/1972 | Lejeune | 162/364 X |
| 3,801,436 | 4/1974 | Prechtel | 162/264 X |

FOREIGN PATENT DOCUMENTS

| | | |
|---|---|---|
| 1118045 | 6/1968 | United Kingdom . |
| 1129757 | 10/1968 | United Kingdom . |
| 1247013 | 4/1971 | United Kingdom . |
| 1329409 | 6/1973 | United Kingdom . |
| 1397378 | 4/1975 | United Kingdom . |
| 1427272 | 3/1976 | United Kingdom . |
| 2460114 | 7/1976 | United Kingdom . |

*Primary Examiner*—Peter Chin
*Assistant Examiner*—Thi Dang
*Attorney, Agent, or Firm*—Burns, Doane, Swecker & Mathis

[57] ABSTRACT

A layer of particulate material is formed by forming a foamed dispersion of a particulate material, supplying the foamed dispersion to a predetermined zone of a plane through which a foraminous element is moving, applying a vacuum to said plane across the zone on the other side of the foraminous element, so as to drain foam and form a particulate layer thereon, removing any free air from the drained foam, and continuously recycling the resulting foam for re-use in forming the foamed particulate dispersion. An apparatus is provided for carrying out the process.

4 Claims, 1 Drawing Sheet

PROCESS AND APPARATUS FOR FORMING PARTICULATE LAYERS

This invention relates to improvements in a process and apparatus for forming fibrous or particulate layers, from foamed dispersions.

UK Patent Specification No. 1397378 discloses a process and apparatus for making fibrous webs from a foamed dispersion of fibres. The process disclosed involves the generation of a foamed fibrous dispersion, the draining of the dispersion on a foraminous material to form a web without substantial breakdown of the foam, and continuously recycling the drained foam for re-use in forming new fibrous dispersion.

The character of the foam used in the foregoing system needs to be relatively stable, so as to both achieve an even distribution of fibres on the foraminous material and facilitate recycling of the foam. Typically, such foams have an air content in excess of 65%, a viscosity of at least 22 seconds measured by Ford Cup No. 4 according to British Standard No. 1733, and in which the air is contained in very small bubbles of in the region of 0.2 millimeters in diameter.

The foregoing patent specification proposes the use of a conventional paper machine Fourdrinier wire and headbox in order to lay down the foamed dispersion. This configuration was, however, susbsequently discovered to have certain disadvantages for use with foam. Thus the vacuum applied through the wet vacuum boxed to drain down the foam for recycling also drew in free air, that is, air uncombined as bubbles in the foam. This free air had the effect of destabilizing the foam in the hydraulic conditions existing in the recycling circuit and produced variations in the character of the recycled foam. As a result, the inability to control the induction of free air imposed a limit on the level of vacuum which could be applied, and thus on the speed and production capacity of the system.

It is one object of the present invention to minimise the destabilization of the foam resulting from the ingress of free air in such a system.

The invention therefore provides a process for forming a layer of particulate material, comprising the steps of forming a foamed dispersion of the particulate material, supplying the foamed dispersion to a predetermined zone of a plane through which a foraminous element is moving, applying vacuum to the plane across the zone on the other side of the foraminous element, so as to drain foam therethrough and form a particulate layer thereon, removing from the drained foam any free air drawn through or past the foraminous element during drainage, and continuously recycling the resulting foam for re-use in forming foamed particulate dispersion.

In this specification, the term "particulate material" is to be taken as including any particles which are capable of being dispersed in a foamed dispersion and specifically as including fibres, for example of wood pulp, glass, metal or, carbon or other suitable fibres.

In another aspect, the invention provides apparatus for forming a layer of particulate material from a foamed dispersion of such material, comprising a movable foraminous element, a headbox having an extended slice disposed above the foraminous element to define a layer forming zone, means for generating foamed fibrous dispersion and supplying it to the headbox, wet vacuum box means disposed below said foraminous element co-extensively with the layer forming zone and slice, for draining foam through the foraminous element to form a particulate layer thereon, means for removing from the drained foam any free air which has entered the vacuum box means during drainage and, means for continuously recycling the resulting foam to the foam generating means.

The means for removing the free air from the drained foam may comprise a secondary vacuum line connected to the vacuum box means at a position above the level of the foam therein. Alternatively, the outlet duct from the vacuum box means may include an in-line centrifugal separator through which the free air is removed by vacuum before the foam is recycled.

The invention will now be further described with reference to the accompanying drawings in which.

Figure 1:
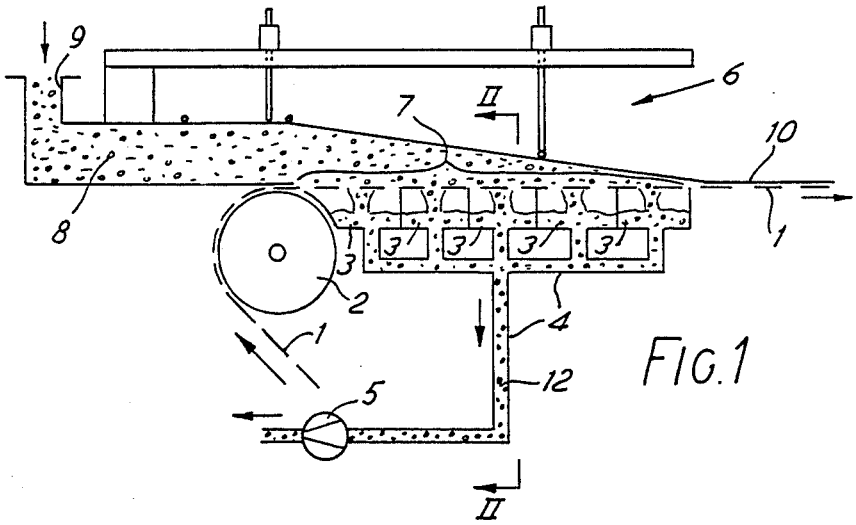
FIG. 1 is a sectional side elevation of part of an apparatus for laying down a particulate or fibrous layer on a foraminous element from a foamed dispersion.

Referring to the drawings, an endless foraminous belt 1, for example a Fourdrinier wire passes over a breast roll 2 and across a series of wet vacuum boxes 3 which are evacuated through ducts 4 by a positive displacement pump 5. A headbox 6 is located above the Fourdrinier wire 1 and has a slice opening 7 co-extensive with the vacuum boxes 3.

In use, foamed fibrous dispersion 8 is fed to the headbox 6 through an inlet duct 9. The dispersion passes through the slice 7 and is drained through the Fourdrinier wire 1 to deposit a fibrous web 10 on the moving Fourdrinier wire. Drainage of the foam through the wire is assisted by the evacuation of the wet vacuum boxes 3 caused by operation of the positive displacement pump 5.

Figure 2:
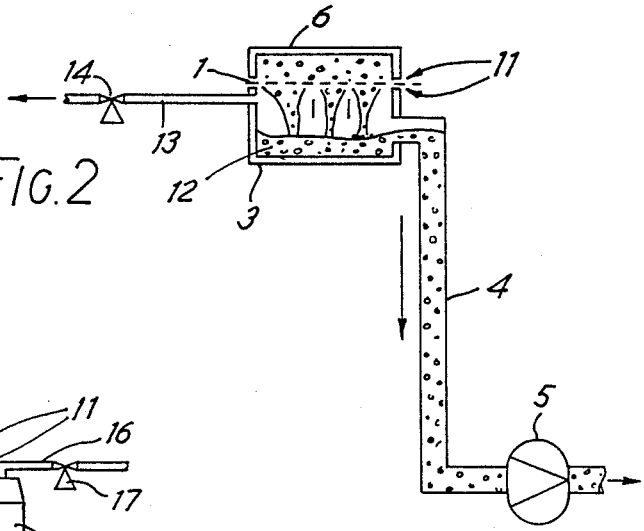
FIG. 2 is a view on the line II—II of FIG. 1, showing in addition one embodiment of an improvement according to the present invention; and, FIG. 3 is a view on the line II—II of FIG. 1, showing in addition a second embodiment of an improvement according to the invention.

As best seen in FIG. 2, in order to faciliate movement of the Fourdrnier wire 1, gaps 11 must be left between the wire and the upper and lower edges of the wet vacuum boxes and slice opening, respectively. The partial vacuum generated in the wet vacuum boxes by the positive displacement pump 5 therefore invitably draws in free air through the gaps 11. The presence of this free air in the system has the effect of destabilizing the drained foam 12 being recycled by the pump 5 to a foamed fibrous dispersion generator of known kind (not shown) which is connected to the inlet duct 9 of the headbox.

Also as shown in FIG. 2, the present invention provides for the secondary application of vacuum by a conventional vacuum pump, such as a liquid ring vacuum pump, through the line 13 and a control valve 14 which may be automatic from a point above the level of the drained foam 12 in the wet vacuum boxes 3.

Figure 3:
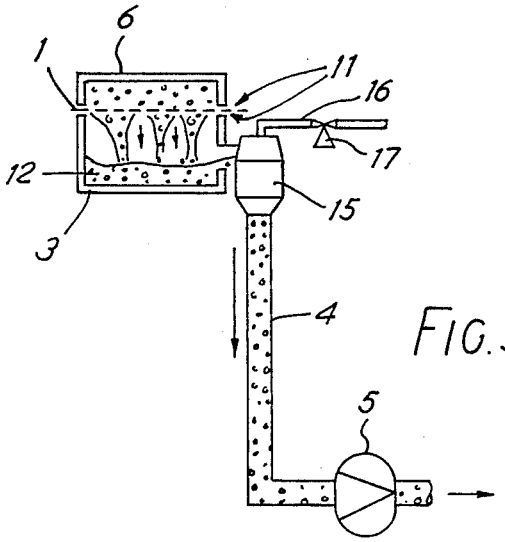

Turning now to FIG. 3, this shows an arrangement similar to that of FIG. 2 but omitting the vacuum line 13 and control valve 14. The remaining features of this embodiment are identified by the same reference numerals as in FIG. 2 and will not be further described. In this embodiment, a centrifugal separator 15 is included in the outlet duct 4 from the vacuum box 3. The centrifugal separator has connected thereto a vacuum line 16 and an automatic control valve 17. The centrifugal separator serves to separate the free air from the foam and discharge it from the system through the vacuum line 16 and valve 17.

By arranging for secondary vacuum applied through the line 13 to remove the free air inducted through the gaps 11, destabilization of the drained foam 12 is prevented. As a result, existent characteristics are maintained in the foam being recycled, the need for make up raw materials is minimised and the rate of production of the web 10 is substantially increased.

The secondary vacuum can also be controlled to increase the pressure differential across the Fourdrinier wire, and thereby increase the weight per unit area of the web 10 being laid down.

We claim:

1. A process for forming a layer including fibrous material, comprising the steps of forming a foamed dispersion of fibrous material, moving a foraminous sheet through a predetermined zone of a plane, supplying said foamed dispersion to the predetermined zone of a plane through which a foraminous element is moving, controlling induction of free air into the predetermined zone by supplying the foamed dispersion through a confined channel defined in part by a head box having a slice coextensive with the predetermined zone on one side of said foraminous element, applying a vacuum to said plane across said zone on the other side of said foraminous element using a wet vacuum means, so as to drain foam therethrough and form a fibrous layer thereon, the drained foam having a level in the vacuum means, removing from said drained foam substantially immediately after drainage any free air drawn through or past the foraminous element during drainage to minimize foam destabilization by providing a vacuum line connected to the vacuum means at a position above the level of the foam therein, and continuously recycling the resulting foam for re-use in forming the foamed fibrous dispersion.

2. A process as claimed in claim 1 in which the fibrous material is selected from the group consisting of wood pulp, glass, metal, and carbon.

3. Apparatus for forming a layer including fibrous material from a foamed dispersion of such material comprising a movable foraminous element, means for controlling induction of free air including a headbox having an extended slice disposed above said foraminous element, the slice defining a layer forming zone, means for generating a foamed fibrous dispersion and supplying it to said headbox, wet vacuum box means disposed below said foraminous element co-extensively with said layer forming zone and slice, for draining foam through said foraminous element to form a fibrous layer thereon, supplemental means for removing from said drained foam substantially immediately after drainage any free air which has entered the vacuum box means during drainage to minimize foam destabilization, wherein the foam has a level in the vacuum box means and wherein the supplemental means for removing the free air from the drained foam includes a vacuum line connected to the vacuum box means at a position above the level of the foam therein and, means for continuously recycling the resulting foam to said foam generating means.

4. Apparatus for forming a layer including fibrous material from a foamed dispersion of such material comprising a movable foraminous element, means controlling induction of free air including a headbox having an extended slice disposed above said foraminous element, the slice defining a layer forming zone, means for generating a foamed fibrous dispersion and supplying it to said headbox, wet vacuum box means disposed below said foraminous element co-extensively with said layer forming zone and slice, for draining foam through said foraminous element to form a fibrous layer thereon, supplemental means for removing from said drained foam substantially immediately after drainage any free air which has entered the vacuum box means during drainage to minimize foam destabilization, wherein the foam has a level in the vacuum box means and wherein the supplemental means for removing the free air from the drained foam includes a conduit means having an in-line centrifugal separator through which the free air is removed by vacuum before the foam is recycled, wherein said conduit means directly communicates with said centrifugal separator for separating air from foam, said conduit means having an inlet in said vacuum box means positioned at the foam level, and means for continuously recycling the resulting foam to said foam generating means.

* * * * *